United States Patent [19]

Zivari

[11] Patent Number: 4,995,668

[45] Date of Patent: Feb. 26, 1991

[54] MODULAR STOOL

[76] Inventor: Bashir Zivari, 266 Washington Ave., C-7, Brooklyn, N.Y. 11205

[21] Appl. No.: 552,161

[22] Filed: Jul. 13, 1990

[51] Int. Cl.[5] ..... A47C 1/124

[52] U.S. Cl. ..... 297/248; 108/64; 297/249

[58] Field of Search ..... 297/248, 249, 232, 439; 108/64, 66

[56] References Cited

U.S. PATENT DOCUMENTS

| | | | |
|---|---|---|---|
| 2,890,087 | 6/1959 | Stevens | 108/64 |
| 2,891,601 | 6/1959 | Mauser | 297/249 |
| 3,600,036 | 8/1971 | Iskander | 297/248 X |
| 3,669,494 | 6/1972 | Lohmeyer | 297/248 X |
| 3,774,962 | 11/1973 | Watamura et al. | 297/249 |
| 3,944,281 | 3/1976 | Piretti | 297/248 X |
| 4,341,419 | 7/1982 | Sebel | 297/248 |

*Primary Examiner*—Peter A. Aschenbrenner
*Attorney, Agent, or Firm*—Michael Ebert

[57] ABSTRACT

A modular stool capable of functioning in a kindergarten or similar facility as an individual seat or as a desk unit for a small child. When interlinked with like stools, one can then create a large ring of stools or a series of staggered stools for group seating, or just a pair of stools forming a love seat. The modular stool is formed from a single blank of plywood or other moldable material that is bent and contoured to define a wedge-shaped seat section and left and right side sections outwardly inclined with respect to the seat section. The side sections of each stool are adapted to be interlinked with the side sections of adjacent stools.

9 Claims, 2 Drawing Sheets

Fig. 1.
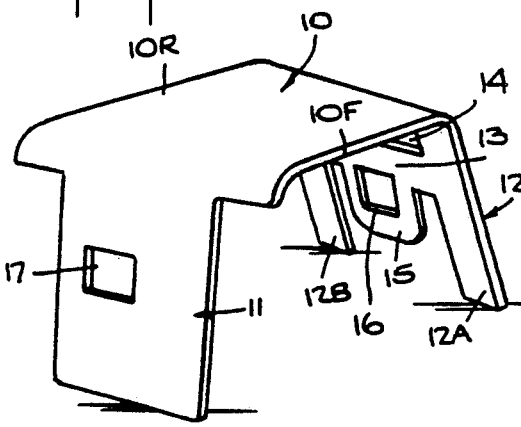
Fig. 2.
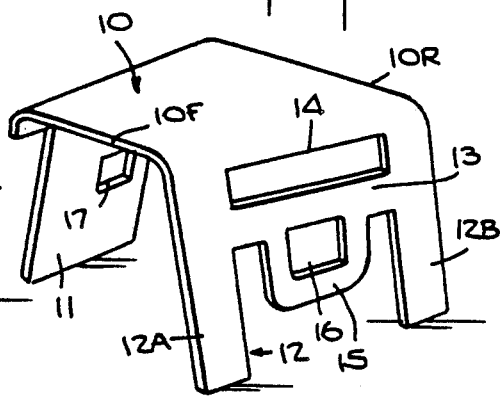
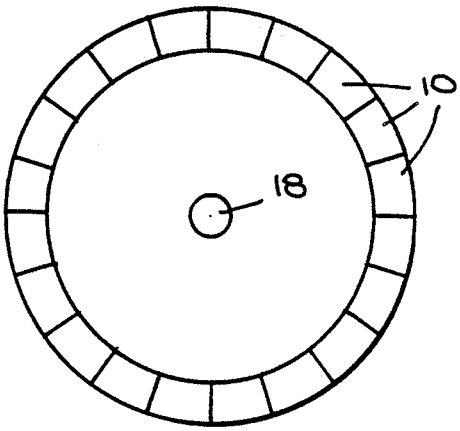
Fig. 3.
Fig. 4.
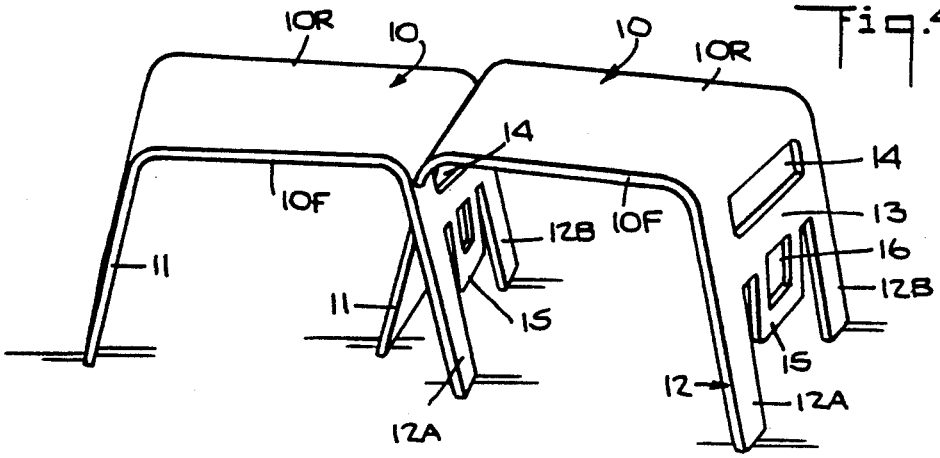

MODULAR STOOL

BACKGROUND OF INVENTION

1. Field of Invention

This invention relates generally to seating stools, and more particularly to a stool module usable in schools, kindergartens and other facilities intended for very young children, the modular stool being capable of functioning as an individual seat or desk unit, or of being so interlinked with like stools as to create three different multi-seating configurations.

2. Status of Prior Art

In schools, kindergartens, play rooms and other facilities intended for small children whose ages lie in the four to eight year range, the need exists for chairs or seats as well as desk units in a scale appropriate to these tots. Thus in a kindergarten having a class of twenty children at least an equal number of chair and desk units are required. While children can play with toys on the floor, a desk unit is desirable, not only to make it more convenient for a child to play with toys, but also to provide an elevated surface on which a child may draw or paint.

The total cost of small chairs and desk units for furnishing a kindergarten or school room is relatively high, even if the cost of an individual chair or stool or of a desk unit is modest. In a period when school budgets are being cut back in order to reduce the tax load on local communities, schools may no longer be able to afford the required number of chairs and desk units.

But apart from the cost factor are space requirements, for one must be able on occasion to clear a kindergarten room of all chairs and desk units in order to provide an unobstructed play area for children. To do this, a storage facility is required to accommodate these furnishings.

In order to reduce storage space requirements, it is known to provide stackable stools or chairs. Thus the Iskander U.S. Pat. No. 3,600,036 discloses reinforced plastic seats that can be stacked one above the other or interlocked in tandem. And the Heyer U.S. Pat. No. 3,430,588, shows three identical stools which can be internested to create a cube requiring relatively little storage space.

SUMMARY OF INVENTION

In view of the foregoing, the main object of this invention is to provide a stackable stool module usable in kindergartens, schools, play rooms and other facilities intended for very young, children, the modular stool being capable of functioning as an individual seat or desk unit, or being so interlinked with like stools as to create three different multi-seat configurations.

More particularly, an object of this invention is to provide a modular stool of the above type which can be readily stacked, and which in one multi-seat configuration assumes a ring formation, in another a staggered row of stools, and in still another, a two-seater or love seat.

Also an object of this invention is to provide a modular stool which is also usable as a desk unit in which the child sitting on the floor with his legs under the desk surface then has his hands positioned over this surface, thereby making it possible for the child to draw or to play with toys placed on the desk.

Yet another object of the invention is to provide a modular stool of the above type which is formed from a single blank of moldable plywood or similar material, and which may be mass produced at low cost.

A significant feature of a modular stool in accordance with the invention is that it is sturdy and free of sharp edges, the stool being capable of surviving rough abuse.

Briefly stated, these objects are attained in a modular stool capable of functioning in a kindergarten or similar facility as an individual seat or as a desk unit for a small child. When interlinked with like stools, one can then create a large ring of stools or a series of staggered stools for group seating, or just a pair of stools forming a love seat. The modular stool is formed from a single blank of plywood or other moldable material that is bent and contoured to define a wedge-shaped seat section and left and right side sections outwardly inclined with respect to the seat section. The side sections of each stool are adapted to be interlinked with the side sections of adjacent stools.

One side section is formed by a pair of parallel narrow legs which are joined to the front and rear ends of the seat section and are bridged by a cross arm that is spaced from the seat section by a transverse slot. Depending from the center of the cross arm is a plate having a socket hole therein. The other side section is formed by a single broad leg centered with respect to the front and rear ends of the seat section and provided with an off-center keyhole that matches the socket hole.

When the stools are interlinked in a ring formation, received in the transverse slot of one stool is the broad leg of the adjacent stool. When the stools are interlinked in staggered relation, one narrow front leg of one stool is received in the keyhole in the broad leg of the adjacent stool. And when a pair of stool are interlinked to form a love seat, the stools are in reverse relation and one narrow leg of the first stool is received in the socket hole of the second stool, and one narrow leg of the second stool is received in the socket hole of the first stool.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a modular stool in accordance with the invention, as seen looking toward its left side;

FIG. 2 shows the stool in perspective, as seen looking toward its right side;

FIG. 3 shows schematically a circular array of interlocked stools which a large group seating ring;

FIG. 4 illustrates the manner in which two adjacent stools in the circular array are interlinked;

DESCRIPTION OF INVENTION

The Modular Stool

Figure 5:
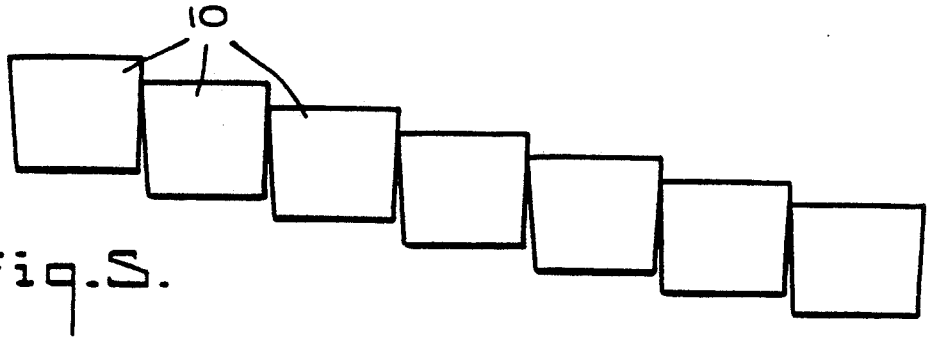
FIG. 5 schematically illustrates a series of interlinked stools in a staggered row.

A modular stool in accordance with the invention, as shown in FIGS. 1 and 2, is fabricated from a single blank of plywood that is bent and cut or contoured, using well known forming techniques to this end, to create the functional elements of the stool. It will be appreciated that stools in accordance with the invention may be fabricated from other high-strength, relatively light-weight, moldable material, such as laminated plastic sheets or aluminum. The advantage of plywood, apart from its low cost, is that this multi-ply wood product is commercially available with attractive face plies or veneers.

The blank from which the stool is fabricated is formed to define a wedge-shaped horizontal seat section 10 whose rear end 10R is somewhat broader than its front end 10E, as well as outwardly inclined left and right side sections 11 and 12 functioning as the legs of the stool. The junctions between the seat section and the side sections which are integral with the seat section are curved, and all exposed edges of the stool are chamfered to avoid sharp points that may cause injury.

Right side section 12 is defined by a pair of narrow legs 12A and 12B of equal width, which are joined respectively to the front and rear ends 10F and 10R of seat section 10. Legs 12A and 12B are bridged by a horizontal cross arm 13 which is spaced from seat section 10 to define a transverse slot 14 extending between these narrow legs. Depending from the cross arm 13 and centered with respect thereto is a plate 15 having a rectangular socket hole 16 therein dimensioned to receive a narrow leg of an adjacent stool, the width of this hole being slightly larger than that of a narrow leg.

Left side section 11 is defined by a single broad leg which is centered with respect to the front and rear ends 10F and 10R of seat section 10 and is provided with an off-center keyhole 17 whose dimensions match those of socket hole 15.

All elements of the modular stool serve a useful function and make it possible, as will later be explained, to so interlink like stools as to form a circular array of stools or a staggered row of stools for group seating, or just a pair of stools to create a double-seat or love seat.

Each stool provides an individual free-standing seat for a small child. In one actual embodiment of this stool made from bent plywood, the dimensions are as follows: 12 inches high, 12 inches deep, 18 inches long and 18 inches wide, the plywood having a thickness of $\frac{3}{8}$ inches. Broad leg 11 is three times wider than a narrow leg (12A or 12B).

The stool can also function as a desk, for the child may sit on the floor with his legs under the stool so that his hands are above the seat section which then serves as a desk surface on which the child can draw or play with toys. And because the side sections are outwardly sloped, the modular stools may be stacked, one above the other.

Circular Array

As shown in FIG. 3, the stools may be interlinked to create a circular array thereof forming a large ring for group seating in a kindergarten, a classroom or other facility in which the teacher 18 is positioned within the ring and the children seated on the stools face the teacher with their legs within the ring, thereby confining the group of seated children. The advantage of this ring arrangement is that it affords the teacher better control of her class of toddlers. With the stool dimensions given above, twenty such stools, when interlinked, create the desired large circle of stools.

The manner in which the stools are interlinked to form a circle is shown in FIG. 4, where it will be seen that the broad leg 11 of the right stool is received in the transverse slot 14 of the left stool, thereby interlinking the two stools. Because of the wedge shape of seat section 10, the two interlinked stools are not in a straight line but in an arc. Successive stools are similarly interlinked to complete the circle.

Staggered Row

In the arrangement shown in FIG. 5, the modular stools are so interlinked as to create a series of stools in a staggered row whose length depends on the number of stools.

Figure 6:
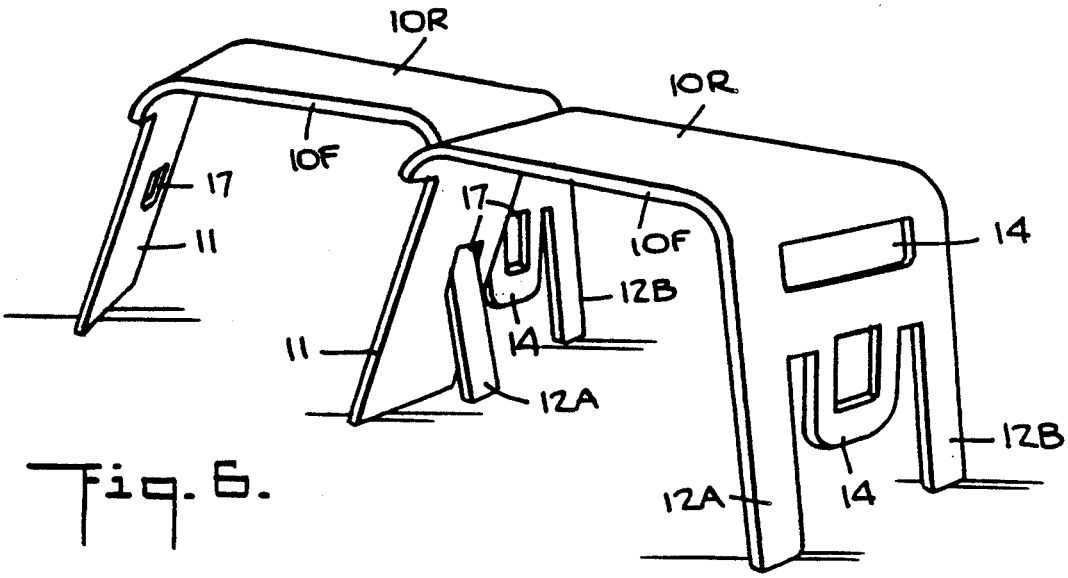
FIG. 6 illustrates the manner in which adjacent stools are interlinked in staggered relation.

The manner in which stools are interlinked to create a staggered row of stools is shown in FIG. 6, where it will be seen that the front narrow leg 12A of the left stool is inserted in the keyhole 17 of the broad leg 11 of the right stool, the right leg 12B of the left stool then being free so that now the left stool is offset somewhat from the right stool to which it is linked. Succeeding stools in the staggered row are similarly interlinked by way of the keyholes 17 in the broad legs into which narrow legs 12A are inserted.

Love Seat

Figure 7:
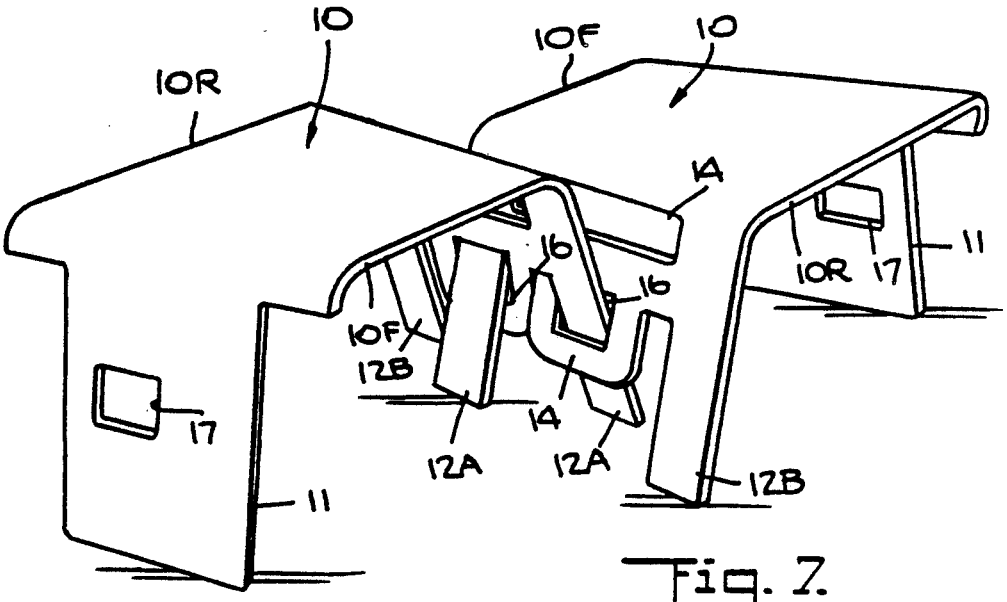
FIG. 7 shows a pair of stools interlinked in reverse relation to form a love seat.

In the love seat configuration as shown in FIG. 7, a pair of stools are interlinked by way of their socket holes 16 in the plates 14.

The right stool is in reverse relation with respect to the left stool, with the front leg 12A of the left stool received in the keyhole 16 of the right stool and the front leg 12A of the right stool received in the keyhole 16 of the left stool, thereby interlinking the two stools to create a love seat in which the seated individuals are seated in opposed relation.

It will be appreciated that because of transverse slot 14, keyhole 16 and socket hole 17 included in each stool, the stools may be interlinked in various ways to provide different multi-seating patterns.

While there has been shown and described a preferred embodiment of a modular stool in accordance with the invention, it will be appreciated that many changes and modifications may be made therein without, however, departing from the essential spirit thereof.

I claim:

1. A modular stool capable of functioning in a kindergarten or similar facility as an individual seat for a child, which stool when interlinked with like stools can be used for group seating, said stool comprising:

(a) a wedge-shaped seat section whose rear end is broader than its front end;

(b) left and right side sections integral with the seat section and outwardly inclined with respect thereto, said left side section being defined by a broad leg centered with respect to said left and right ends of the seat section, said right side section being defined by left and right narrow legs joined to the front and rear ends of the seat section; and (c) a cross arm bridging the narrow legs below the seat section to define a transverse slot whose width is substantially equal to that of the broad leg, whereby two stools may be interlinked by inserting the broad leg of one into the slot of the other.

2. A stool as set forth in claim 1, further including a plate depending from said cross arm and centered with respect to said narrow legs, said plate having a socket hole therein whose width substantially matches that of a narrow leg, whereby two stools may be interlinked by inserting one narrow leg of one stool in the socket hole of the other.

3. A stool as set forth in claim 1, wherein said broad leg has an off-center keyhole therein whose dimensions match those of said socket hole, whereby two stools may be interlinked by inserting a narrow leg of one stool in the keyhole of the other stool.

4. A closed ring of like stools of the type set forth in claim 1, in which the stools in the ring are interlinked by inserting the broad leg of each stool in the ring into the slot of the adjacent stool.

5. A staggered row of like stools of the type set forth in claim 2, in which the stools are interlinked by inserting a narrow leg of one stool in the row in the keyhole of the adjacent stool.

6. A love seat formed by a pair of like stools as set forth in claim 3, in which the stools are in reverse relationship, and narrow leg of each stool is inserted in the socket hole of the other stool.

7. A stool as set forth in claim 1, wherein the stool is fabricated from a single blank of plywood that is bent and cut to define the sections of the stool.

8. A stool as set forth in claim 7, wherein the side sections at their junctions with the seat section are curved to avoid a sharp transition therebetween.

9. A stool as set forth in claim 8, wherein exposed edges of the stool are chamfered to avoid sharp points.

* * * * *